US006588508B2

(12) United States Patent
Parrott et al.

(10) Patent No.: US 6,588,508 B2
(45) Date of Patent: Jul. 8, 2003

(54) METHOD AND APPARATUS TO REDUCE TRAPPED PRESSURE IN A DOWNHOLE TOOL

(75) Inventors: Robert A. Parrott, Houston, TX (US); Haoming Li, Missouri City, TX (US); Anthony P. Vovers, Houston, TX (US); Cynthia L. Hickson, Sugar Land, TX (US); Harry B. Anderson, Richmond, TX (US); John M. Corben, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/920,430

(22) Filed: Aug. 1, 2001

(65) Prior Publication Data

US 2002/0033264 A1 Mar. 21, 2002

Related U.S. Application Data

(60) Provisional application No. 60/222,431, filed on Aug. 1, 2000.

(51) Int. Cl.[7] ..... E21B 43/116; E21B 29/02; E21B 43/11

(52) U.S. Cl. ..... 166/297; 166/298; 166/55; 166/230; 166/235

(58) Field of Search ..... 166/55, 55.1, 63, 166/297, 298, 332.6, 332.7, 230, 231, 235; 175/4.54

(56) References Cited

U.S. PATENT DOCUMENTS

| | | | | | |
|---|---|---|---|---|---|
| 4,372,384 | A | * | 2/1983 | Kinney | 166/278 |
| 4,428,431 | A | * | 1/1984 | Landry et al. | 166/298 |
| 5,044,388 | A | * | 9/1991 | Barton et al. | 137/15.08 |
| 5,355,957 | A | * | 10/1994 | Burleson et al. | 166/297 |
| 5,979,551 | A | * | 11/1999 | Uban et al. | 166/233 |
| 6,006,829 | A | * | 12/1999 | Whitlock et al. | 166/228 |
| 6,220,370 | B1 | * | 4/2001 | Wesson et al. | 175/4.52 |

* cited by examiner

*Primary Examiner*—David Bagnell
*Assistant Examiner*—Brian Halford
(74) *Attorney, Agent, or Firm*—Trop, Pruner & Hu PC; Jeffrey Griffin; Brigitte Jeffery

(57) ABSTRACT

A tool string for use in a well includes a filter sub (or trapped pressure regulator sub) that is used with other components to reduce trapped pressure. The filter sub filters out debris that may occur from various types of downhole operations, such as perforating operations. By filtering out larger debris, only gases, liquids, and smaller particles are allowed to enter various components of the tool string. Without the presence of larger solid debris inside certain components of the tool string, the likelihood of plugs being formed is reduced so that gases and liquids can more readily pass out of the tool string as the tool string is retrieved to the surface of the well and the well hydrostatic pressure decreases.

26 Claims, 3 Drawing Sheets

METHOD AND APPARATUS TO REDUCE TRAPPED PRESSURE IN A DOWNHOLE TOOL

CROSS REFERENCE TO RELATED APPLICATION

This claims the benefit under 35 U.S.C. §119(e) of U.S. Provisional Application Ser. No. 60/222,431, filed Aug. 1, 2000.

TECHNICAL FIELD

The invention relates to reducing and releasing trapped pressures inside downhole tools.

BACKGROUND

In completing a well, various types of downhole tools are run into the wellbore. One type of tool is a perforating gun string, which typically includes one or more gun sections. If multiple gun sections are present, spacer sections can be located between the gun sections to provide a desired spacing between the gun sections. Various different types of perforating guns can be used. One type is the hollow carrier gun, which includes a hollow carrier containing shaped charges. The hollow carrier provides a sealed chamber that protects the shaped charges from wellbore fluids and high pressures inside a wellbore. Another type of perforating gun does not employ hollow carriers, but instead uses capsule shaped charges that are contained in individual sealed capsules and which are typically carried on strips or other types of carriers.

In operation, the perforating gun string is lowered into the wellbore to a desired depth. In a hollow carrier gun, the inside chamber of the hollow carrier in which the shaped charges are contained is typically at atmospheric pressure. The outside of the hollow carrier is exposed to the pressure of wellbore fluids, which can be at hydrostatic pressure or a higher formation pressure. When the gun string is detonated, explosive gases at a high pressure are created inside the gun, with a portion of the gases entering the wellbore through perforated openings of the hollow gun carrier. After the explosive gases cool, they are overcome by the typically higher wellbore pressures, with the wellbore fluids entering the guns through the perforated openings in the hollow gun carrier. After filling the hollow gun carriers, the wellbore fluids fill spacer subs until pressures are equalized at the wellbore pressure.

As the wellbore fluid enters the spacer subs, debris and explosive gases from the perforating operation may also be carried into the spacer subs. As a result, the spacer subs are filled with compressed air, compressed explosive gases, wellbore fluids, and debris (e.g., gun debris, formation debris or other debris). Typically, the heavier components of the mixture start to settle out to the bottom of each spacer sub.

As the gun string is retrieved from the wellbore, the hydrostatic pressure outside the gun string gradually decreases. The compressed air and explosive gases that are inside the spacer subs expand to expel liquids, gases and debris from the upper and lower ends of the spacer subs. However, some of the larger pieces of debris may create plugs that prevent further expulsion of fluids and debris, which then limits the expansion of the remainder of the liquid and explosive gases as the pressure outside the gun string continues to decrease as the gun string is raised. Consequently, relatively high pressure (along with gases and well liquids) may be trapped in some spacer subs.

At the well surface, the pressure outside a retrieved gun string is atmospheric pressure. However, the trapped pressure inside the spacer subs can be much greater than the atmospheric pressure. This poses a safety concern as the gun string is disassembled at the well surface. The trapped pressure inside the guns may be suddenly and unexpectedly released, causing injury to well personnel. Also, the trapped well liquids and gases can also pose contamination concerns for the environment.

The chance of encountering trapped pressure inside a retrieved gun string increases as the number and length of spacer subs increase, as the hydrostatic pressure encountered increases, and as the wellbore fluids become thicker, heavier and more viscous.

A need thus exists for an improved method and apparatus to reduce trapped pressure inside downhole tools, such as perforating guns.

SUMMARY

In general, according to one embodiment, a perforating gun string comprises a gun section and a filter sub connected to the gun section, the filter sub containing a filter having a multilayered assembly containing plural screens.

In general, according to another embodiment, an apparatus for use in a gun string having a gun section in a wellbore comprises a body adapted to be connected to the gun section and a multilayered assembly having plural screens inside the body to filter out debris.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
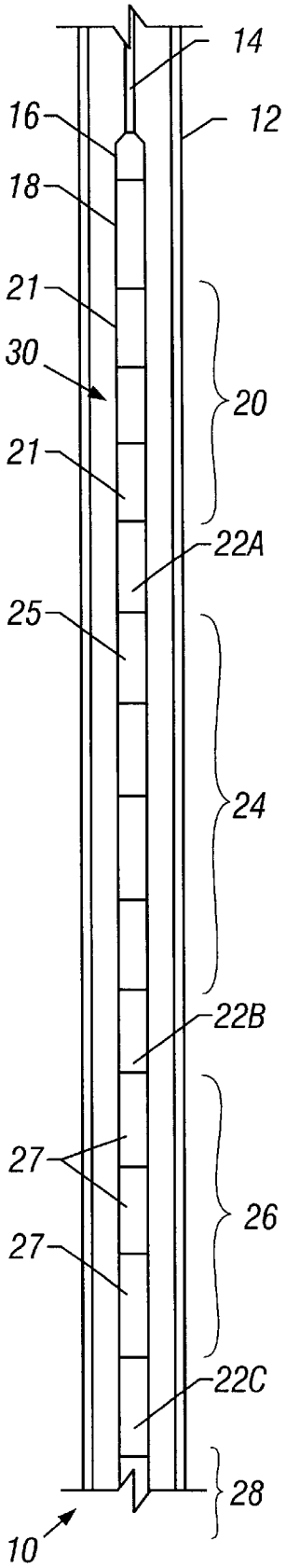
FIG. 1 illustrates an embodiment of a perforating gun string.

Referring to FIG. 1, a perforating gun string 30 is positioned inside a wellbore 10 that is lined with casing or liner 12. The gun string is lowered by a carrier line 14, such as a wireline, slickline, tubing, drillpipe, or coiled tubing. An adapter 16 connects the carrier line 14 to a firing head 18. A spacer section 20 may be connected to the firing head 18 to provide some distance to a first perforating gun section 24. The spacer section 20 includes a series of spacer subs 21. Connected below the spacer section 20 is a first trapped pressure regulator sub 22A (also referred to as a filter sub) in accordance with some embodiments of the invention. The first gun section 24 is connected below the trapped pressure regulator sub 22A. The gun section 24 includes a series of guns 25 to provide the desired perforation interval length.

Connected below the gun section 24 is another trapped pressure regulator sub 22B, which is further connected to another spacer section 26 that includes a series of spacer subs 27. Attached below the spacer section 26 is a third trapped pressure regulator sub 22C, which in turn is connected to another gun section 28. Thus, in the example of FIG. 1, two gun sections 24 and 28 are illustrated, with the gun sections 24 and 28 separated by a spacer section 26. In addition, the upper gun section 24 is spaced from the firing head 18 by a spacer section 20.

In the illustrated example, each trapped pressure regulator sub 22 (22A, 22B, or 22C) is connected between a spacer section and a gun section. Effectively, instead of connecting a spacer section directly to a gun section, as is conventionally done, the trapped pressure regulator sub according to some embodiments is used to connect the spacer section to the gun section. In other embodiments, instead of being used with gun strings, the concept of the trapped pressure regulator sub (or filter sub) can be used with other types of downhole tools for reducing trapped pressure.

The trapped pressure regulator sub 22 has one or more multilayered filter assemblies that are designed to screen and prevent debris from entering the spacer subs in the spacer sections 20 and 26. By filtering out larger debris, only gases, liquids, and smaller particles enter the spacer subs after a perforating operation. Without the presence of larger solid debris inside the spacer subs, the likelihood of plugs being formed is reduced so that gases and liquids can more readily pass out of the spacer subs as the gun string is retrieved to the surface and well hydrostatic pressure decreases.

In the event that plugs are formed anyway, the trapped pressure regulator subs 22 contain pressure release ports to safely release the trapped liquids and gases. At the well surface, the liquids can be directed from the release ports to a separate container to prevent contamination of the environment.

The trapped pressure regulator sub 22 may also contain a feature that opens a port at the time that a gun string is detonated or shot. The opened port enables liquids and gases to have an alternative route (in addition to the route through the one or more multilayered filter assemblies) to escape from the spacer subs as the gun string is retrieved from the wellbore. Such a feature can be accomplished by a break plug, a valve, a pierceable web, and so forth.

Figure 2:
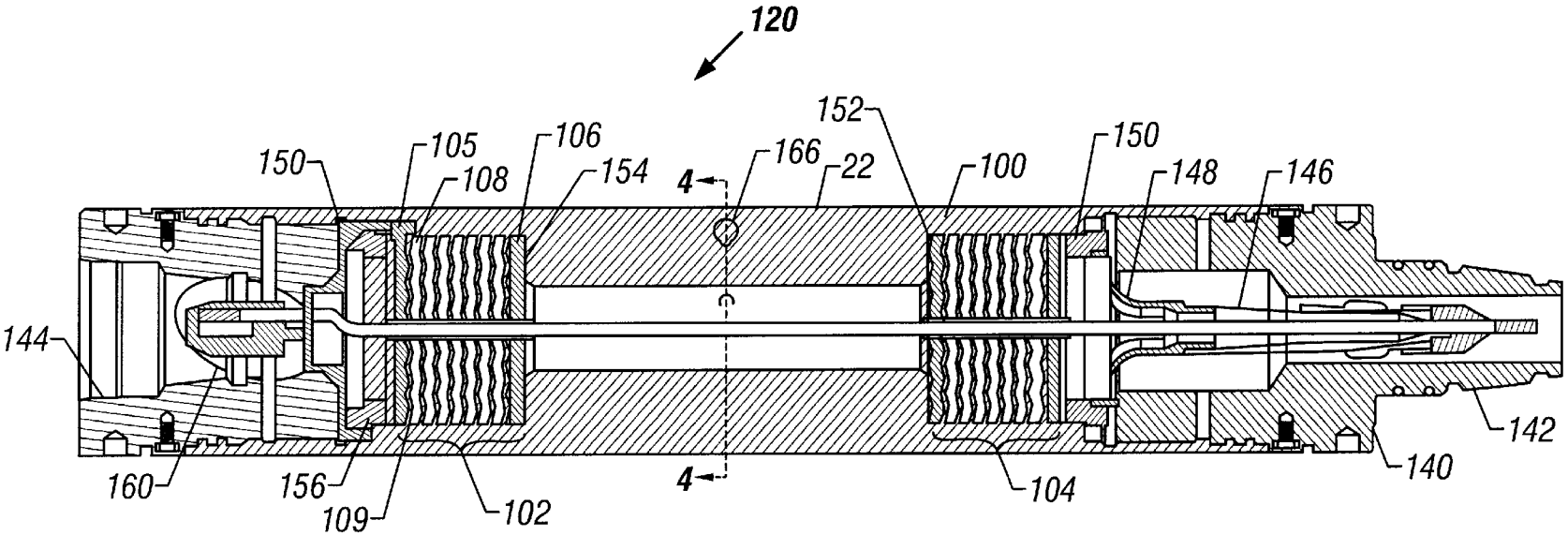
FIG. 2 is a longitudinal sectional view of a trapped pressure regulator sub used in the perforating gun string of FIG. 1, in accordance with an embodiment.
Figure 6:
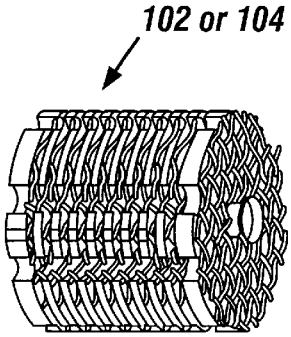
FIG. 6 is a perspective view of the multilayered filter assembly of FIG. 3.

Referring to FIG. 2, a longitudinal sectional view of a trapped pressure regulator sub 22 (or filter sub) is illustrated. The sub 22 includes a housing 100 in which a first multilayered filter assembly 102 and a second multilayered filter assembly 104 are positioned. Alternatively, a single multilayered filter assembly or more than two multi-layered filter assemblies can be used. In the illustrated embodiment, the multilayered filter assembly 102 includes alternating layers of screens and meshes 109. The screens are formed of perforated metal sheets. The outer screen layers 105 and 106 are designed to be thicker than the remaining screens 108 to provide extra support to help resist forces from wellbore pressures and also to prevent larger pieces of debris from entering the filter assembly 102. Mesh layers 109 are provided between successive screens 105, 106 and 108. A perspective view of the multilayered filter assembly 102 and 104 is shown in FIG. 6.

Figure 3A:
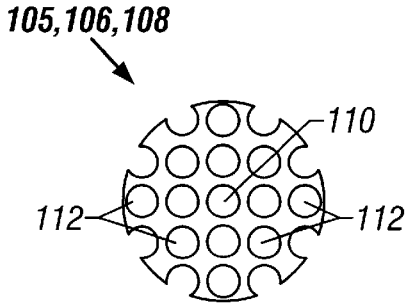
FIG. 3A is a front view of a screen that is part of a multilayered filter assembly used in the trapped pressure regulator sub of FIG. 2.

As shown in FIG. 3A, a front view of an example screen layer (105, 106 or 108) is illustrated. A central opening 110 is provided to enable a detonating cord 120 (FIG. 2) to pass through. The screen also includes a number of filtering openings 112. The pattern of the filtering openings 112 can be one of any number of patterns. Each of the filtering openings 112 has a predetermined size. In one embodiment, the filtering openings 112 of the screens 105, 106 and 108 are designed so that the filtering openings in the outer screens 105 and 106 are larger than the filtering openings of the inner screens 108. The varying opening sizes are provided to enable larger debris to be screened out at the outer edges with progressively smaller debris screened by the inner screens 108.

Figure 3B:
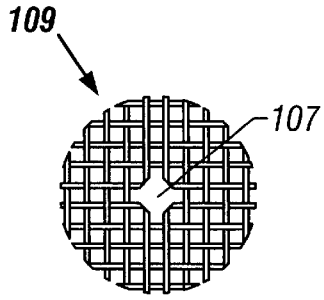
FIG. 3B is a front view of a mesh that is part of the multilayered filter assembly.

FIG. 3B shows a front view of the mesh layer 109 located between successive screens. In one embodiment, the mesh layer 109 is formed of a wire cloth material, although other types of materials can be used in other embodiments. The mesh layer 109 has a pattern of vertical and horizontal wires as well as a central opening 107 to allow the detonating cord 120 to pass through.

The multilayered filter assembly 104 has similar layers as the filter assembly 102. The two filter assemblies 102 and 104 are provided in the trapped pressure regulator sub 22 to enable the filtering of debris from either side of the sub 22.

At a first end, the sub 22 has a connector member 140 that provides a threaded section 142 adapted to be connected to the next sub. The threaded section 142 is designed to fit into a receptacle similar to the receptacle 144 at a second, opposite end of the sub 22. In one embodiment, the sub 22 is designed to have substantially the same predetermined length (e.g., 2 feet) and substantially the same outer diameter as spacer subs and gun carriers. In other embodiments, the length of the filter subs, and spacer subs are different.

The connector member 140 is connected to the housing 100 of the sub 22. A donor extension 146 is provided inside the connector member 140 to enable the connection of the detonating cord 120 to the detonating cord in the next sub. A lower alignment plate 148 is connected to the donor extension 146. A retainer ring 150 is abutted to the alignment plate 148, with the retainer ring 150 providing support for one side of the filter assembly 104. The other side of the filter assembly 104 sits on a ledge 152 provided by the inner wall of the housing 100.

Similarly, in the upper portion of the sub 22, the filter assembly 102 sits on a ledge 154, with the other side of the filter assembly 102 abutted against a retainer ring 156. The retainer ring 156 is abutted to a alignment plate 158, which in turn is connected to a transfer receptor 160 that receives a detonated cord.

In operation, the perforating gun string 30 (FIG. 1) is run to a desired wellbore depth. The firing head 18 is activated to initiate a detonating cord, which causes firing of the gun sections 20 and 26. The fired gun sections create perforated openings in the gun subs 21 and 27. Since the wellbore pressure is much higher than the internal pressure of the spacer subs 18 and 25 (typically at atmospheric pressure), well fluids carrying explosive gases and debris start flowing into the spacer subs through the gun sections. With the trapped pressure regulator subs 22 placed between the gun subs and the spacer subs, however, much of the larger debris is prevented from entering the spacer subs to reduce likelihood of plugging.

After firing, the perforating gun string is raised to the well surface. As the gun string is raised, the wellbore hydrostatic pressure decreases, allowing the accumulated fluids in the spacer subs to flow back out.

Figure 4:
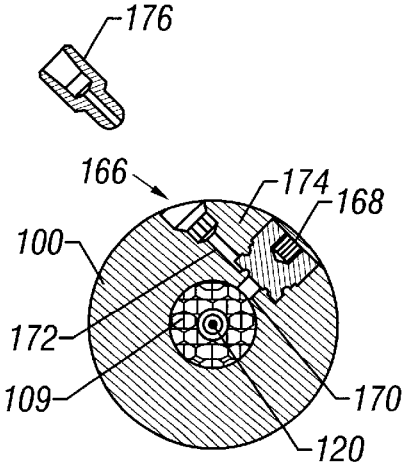
FIG. 4 is a cross-sectional view of a portion of the trapped pressure regulator sub of FIG. 2.

Referring to FIG. 4, another feature of the trapped pressure regulator sub 22 is a relief port 166 to release any remnants of trapped pressure within the sub 22 after the sub 22 has been retrieved to the well surface. The relief port 166 includes a port plug 168 designed to provide a seal against a radial port 170 in communication with the inner chamber of the sub 22. Another port 172 in the sub housing 100 leads to the outlet that is covered by a filler plug 174. In the illustrated position, the port plug 168 provides a seal between ports 170 and 172.

In operation, after the sub 22 has been retrieved to the well surface, the filler plug 174 is removed from the sub 22, and replaced with a filler connection 176. The filler connection 176 can be connected to a hose or other suitable conduit, with the hose or conduit leading to a container to receive any trapped gases and liquids inside the sub 22. To release the trapped gases and liquids, the port plug 168 is rotated outwardly to remove the seal between the ports 170 and 172. This enables the flow of trapped liquids and gases through the ports 170, 172 and the filler connection 176 to the hose or conduit.

Figure 5:
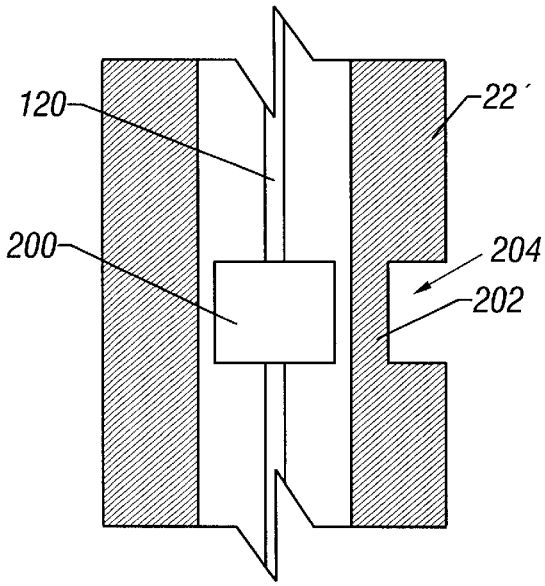
FIG. 5 is a longitudinal sectional view of a portion of a trapped pressure regulator sub in accordance with another embodiment.

Referring to FIG. 5, a portion of a trapped pressure regulator sub 22' in accordance with an alternative embodiment is illustrated. In the trapped pressure regulator sub 22', in addition to the multilayered filter assemblies, a web 204 is provided in the housing of the sub 22'. The web 204 has a thinned region 202 that is designed to break in response to detonation of an explosive 200 inside the sub 22'. The explosive 200 is connected to the detonating cord 120. Thus, in operation, when the perforating gun sections are shot, the detonating cord 120 also sets off the explosive 200 to shear the thinned region 202. This provides an opening from the inside of the sub 22' to the wellbore to provide an alternate route for trapped gases and liquids (in addition to the route through the multilayered filter assemblies). The explosive 200 is selected to be of a type that reduces explosive force experienced by the surrounding casing to reduce the likelihood of damage to the casing. Alternatively, instead of the explosive 200, the detonation of the detonating cord is sufficient to pierce the web 204.

In other embodiments, other types of shearable elements may be employed, such as a breakable plug, a shearable disk, and the like. Valves or other types of flow control devices may also be used.

In yet a further embodiment, the shearable element may be part of a spacer sub rather than the trapped pressure regulator sub. This feature may be provided in addition to the trapped pressure regulator sub. Alternatively, the feature can be provided instead of the trapped pressure regulator sub to relieve pressure from inside a gun string.

Although reference has been made to perforating gun strings in the described embodiments, other embodiments may include other types of downhole tools in which the trapped pressure regulator sub (or filter sub), as illustrated in FIG. 2, or a variation thereof, may be employed to reduce or eliminate trapped pressure inside portions of the downhole tools. This may be desirable in any type of tool in which the internal chambers of the tool, which may initially be at atmospheric pressure, is suddenly exposed to wellbore pressures (e.g., hydrostatic pressure or formation pressure). The sudden exposure to such high pressures may cause fluids and debris to suddenly rush into the downhole tool. By using the trapped pressure regulator sub (or filter sub) in accordance with some embodiments, the larger debris may be filtered out so that subsequent plugging of portions of the downhole tool can be reduced or eliminated.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A perforating gun string, comprising:

a gun section; and a filter sub connected to the gun section and containing a filter having a multilayered assembly containing plural screens wherein the multilayered assembly processes an axis generally parallel to the longitudinal axis of the performing gun string.

2. The perforating gun string of claim 1, wherein the screens each has a plurality of openings, the openings each having a predetermined size.

3. The perforating gun string of claim 2, wherein the predetermined sizes of the openings of at least two screens are different.

4. The perforating gun string of claim 1, wherein the screens each have a plurality of openings, wherein the openings of at least two screens vary in size.

5. The perforating gun string of claim 4, wherein the multilayered assembly has at least first, second and third screens, with the second screen being between the first and third screens, and wherein the openings of the first and third screens are larger than the openings of the second screen.

6. The perforating gun string of claim 1, wherein the multilayered assembly further comprises meshes between screens.

7. The perforating gun string of claim 1, wherein the gun section has plural gun subs each having a predetermined length, wherein each filter sub has substantially the same predetermined length.

8. The perforating gun string of claim 1, further comprising a spacer section, the filter sub between the spacer section and the gun section.

9. The perforating gun string of claim 8, wherein the gun section has gun subs, the spacer section has spacer subs, and wherein the gun subs, spacer subs, and filter sub have substantially the same length.

10. The perforating gun string of claim 8, wherein the gun subs, spacer subs, and filter subs have different lengths.

11. The perforating gun string of claim 1, wherein each screen has an opening to receive a detonating cord and plural other openings to filter debris.

12. The perforating gun string of claim 1, wherein the filter sub further comprises at least another filter having a multi-layered assembly.

13. The perforating gun string of claim 1, wherein the filter sub has a relief port that is manipulable to release trapped pressure inside the filter sub.

14. The perforating gun string of claim 1, wherein the filter sub has a shearable element covering a port between the inside of the filter sub and the outside of the filter sub.

15. The perforating gun string of claim 14, wherein the shearable element comprises a web.

16. The perforating gun string of claim 14, wherein the filter sub further comprises an explosive, the web being shearable by the explosive.

17. An apparatus for use in a gun string having a gun section in a wellbore, comprising:

a body adapted to be connected to the gun section; and a multilayered assembly having plural screens inside the body to filter out debris wherein the multilayered assembly possesses an axis generally parallel to the longitudinal axis of the gun string.

18. The apparatus of claim 17, wherein the screens each have plural openings, one opening for receiving a detonating cord and at least another filtering opening sized to filter out debris of greater than a predetermined size.

19. The apparatus of claim 18, wherein the filtering openings of different screens vary in size.

20. The apparatus of claim 18, wherein the multilayered assembly has a stack of screens, an outermost screen having larger filtering openings and one or more inner screens having smaller filtering openings.

21. The apparatus of claim 20, wherein the outermost screen has a first thickness and at least one of the one or more inner screens have a second thickness, the first thickness being greater than second thickness.

22. The apparatus of claim 20, wherein the outermost screen is in closest proximity to outside wellbore fluids.

23. An apparatus for filtering debris in a wellbore, comprising:

a housing having a longitudinal bore;

a multilayered assembly positioned in the longitudinal bore having a plurality of screens each having plural filtering openings, the filtering openings of at least two screens varying in size, the plural filtering openings each having an axis generally parallel to a longitudinal axis of the longitudinal bore.

24. A method of performing a perforating operation in a wellbore, comprising:

shooting a gun in a string in the wellbore; and providing a filter device having a multilayered assembly of plural screens to remove debris entering the string after the gun is shot, wherein the multilayered assembly possesses an axis generally parallel to the longitudinal axis of the string.

25. The method of claim 24, further comprising retrieving the gun string after the perforating operation, the filter device enabling pressure to be released from the gun string as the gun string is being raised.

26. A perforating gun string for use in a wellbore, comprising:

a gun section; and a spacer section connected to the gun section, the spacer section having one or more spacer subs, each of the one or more spacer subs having a shearable element to shear upon or after firing of the gun section, the shearable element when sheared providing an opening in the spacer sub for pressure relief; and the spacer section further having a filter device having a multilayered assembly of plural screens adapted to filter debris fluids entering the one or more spacer subs as a result of firing of the gun section wherein the multilayered assembly possesses an axis generally parallel to the longitudinal axis of the performing gun string.

* * * * *